United States Patent [19]

Swiatkowski

[11] Patent Number: 4,612,112

[45] Date of Patent: Sep. 16, 1986

[54] AMIDOCARBOXYLIC ACIDS AS FLOTATION AGENTS

[75] Inventor: Piotr Swiatkowski, Huddinge, Sweden

[73] Assignee: Kenobel AB, Nacka, Sweden

[21] Appl. No.: 707,221

[22] Filed: Mar. 1, 1985

[30] Foreign Application Priority Data

Mar. 7, 1984 [SE] Sweden ..... 8401241

[51] Int. Cl.[4] ..... B03D 1/02

[52] U.S. Cl. ..... 209/166; 252/61

[58] Field of Search ..... 209/167, 166; 252/61

[56] References Cited

U.S. PATENT DOCUMENTS 4,043,902 8/1977 Hartjens ..... 209/166

4,514,290 4/1985 Swiatkowski et al. ..... 209/166

FOREIGN PATENT DOCUMENTS 2054649 5/1972 Fed. Rep. of Germany .

*Primary Examiner*—Bernard Nozick

*Attorney, Agent, or Firm*—Fred Philpitt

[57] ABSTRACT

Amidocarboxylic acids containing a hydrophobic group on the nitrogen are used as flotation agents. They are particularly useful as collector agents in the separation of non-sulfide minerals from their gangues.

19 Claims, No Drawings

AMIDOCARBOXYLIC ACIDS AS FLOTATION AGENTS

The present invention relates to a process for enriching minerals by froth flotation using certain amidocarboxylic acids containing a hydrophobic group. The amidocarboxylic acids are preferably used for separation of nonsulfide minerals from their gangues.

Derivatives of sarcosine and related amidocarboxylic acids, containing a hydrophobic group on the carbon of the amido group, are well-known flotation agents for different minerals. These types of amidocarboxylic acids are, however, comparatively expensive and they often give rise to an undesirably high degree of foam formation and the formed foam has a high stability.

According to the present invention it has been found that another group of amidocarboxylic acids, namely N-acylated aminocarboxylic acids, can be used as collector reagents for separation of minerals by froth flotation. These amidocarboxylic acids can be used at low temperatures and in hard water and they can further be added to the pulp in pure form without being diluted and this without requirements on exceptionally long conditioning times. Compared with sarcosine derivatives, such as for example N-oleoylsarcosinate, the amidocarboxylic acids used according to the invention have a substantially lower tendency to form bulky, difficult foam. The present amidocarboxylic acids do in many instances give a better metallurgical result than previously known amidocarboxylic acids for flotation use and they are further very advantageous on a cost-performance basis.

The present invention thus relates to a process for separation of minerals from their gangues by froth flotation in which process the flotation is carried out in the presence of an amidocarboxylic acid having the general formula

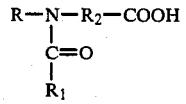

wherein R is an organic, hydrophobic group having at least 6 carbon atoms, $R_1$ is hydrogen or a lower aliphatic group having 1 to 4 carbon atoms or such an aliphatic group substituted with a carboxylic group and $R_2$ is a straight or branched alkylene group with 1 to 6 carbon atoms, or a salt thereof.

The amidocarboxylic acids used for flotation according to the present invention are characteristic in that the nitrogen of the amido group is substituted with an organic, hydrophobic group. This type of amidocarboxylic acids, which can be classified as N-acylated aminocarboxylic acids, is per se previously known from the published German patent application 2054649 which discloses a process for their preparation and their use mainly as textile additives.

In the amidocarboxylic acids of the above formula for flotation use the organic, hydrophobic group R suitably has 6 to 22 carbon atoms and is suitably a saturated or unsaturated, straight or branched, aliphatic group and preferably with 8 to 18 carbon atoms. As example of groups can be mentioned octyl, nonyl, decyl, dodecyl, tridecyl, tetradecyl, pentadecyl, heptadecyl, octadecyl and higher alkyl groups with up to 22 carbon atoms, and the corresponding unsaturated groups among which as some examples can be mentioned decenyl, tridecenyl, hexadecenyl, heptadecenyl, octadecenyl, eicosenyl etc, di- and polyunsaturated groups with at least 6 carbon atoms. The organic hydrophobic group can also be alkyl substituted aryl or aralkyl groups, cycloalkyl groups or alkylsubstituted cycloalkyl groups with at least 6 carbon atoms. As some examples of such groups can be mentioned octylphenyl, nonylphenyl, dodecylphenyl, tridecylphenyl, nonylcyclopropyl, dodecylcyclobutyl etc. All the organic hydrophobic groups may of course contain oxygen bridges or other inert substituents which do not negatively influence the hydrophobic properties of the groups or the affinity of the compounds to minerals.

The compounds can be used in the form of acids or as salts thereof. Salts are often used for practical reasons and hereby primarily refer to salts of alkali metals, of ammonium or lower alkyl or hydroxyalkylamines with 1 to 4 carbon atoms. Among the salts alkali metal salts, and particularly sodium salts, are most often used, and this is, of course, primarily dependent on the pH in the systems. Further, the use of mixtures of compounds according to the general formula is, of course, encompassed by the invention and such mixtures can, besides by simple mixing of derivatives before the use, be obtained in the production of the amidocarboxylic acids by using mixtures of the starting materials, e.g. by starting from a mixture of aminocarboxylic acids or by acylating an aminocarboxylic acid with two or several different acylating agents.

As mentioned above, $R_1$ is hydrogen or a lower aliphatic group with 1 to 4 carbon atoms or such a group substituted with a carboxylic group. $R_2$ is a straight or branched alkylene group with 1 to 6 carbon atoms, preferably with 1 to 4 carbon atoms. Most preferably $R_2$ is a methylene-, ethylene- or an isopropylene-group.

The amidocarboxylic acids used according to the invention are preferably prepared from an aminocarboxylic acid containing an organic hydrophobic group and an acylating reagent. Simple, easily available and cheap raw materials can thus be used throughout. The acylating reagent is a lower organic acid, a mono- or diacid, and suitably an anhydride or halide of this. Reaction of the aminocarboxylic acid with a diacid derivative results in compounds wherein $R_1$ is substituted with a carboxylic group and wherein $R_1$ may contain a double bond. The raw reaction product of a process as described can usually be used for flotation purposes, without preceding complicated purification by using only simple operations such as washing with water and filtration, and this further improves the cost-performance relationship at the flotation.

The process for separation of minerals from their gangues comprises the steps of forming a pulp from the raw mineral, optionally adding a depressor for the gangues and optionally conditioning the pulp, treating the pulp with an effective amount of the amidocarboxylic acid and separating the minerals by froth flotation, collecting the minerals as froth product and removing the gangues as tailings.

The amidocarboxylic acids are preferably used for separation of non-sulfide minerals from their gangues. As examples of non-sulfide minerals which can be upgraded according to the present invention can be mentioned minerals which contain alkaline earth metals such as apatite, scheelite, wolframite, magnesite and baryte which usually are associated with silicates, silica and iron minerals of different kinds and from which they can be separated by flotation processes. Other minerals which can be upgraded using the amidocarboxylic acids are hematite and other kinds of iron minerals such as cassiterite, chromite etc.

The flotation process is carried out in a conventional manner. A pulp is formed from the raw mineral and this, after optional conditioning, is subjected to treatment with air in the presence of the collector reagent. The minerals will hereby be hydrophobed and obtained as froth product while the gangues will be removed as tailings. The flotation conditions are selected in per se known manner with respect to the mineral. Flotation of minerals containing alkaline earth metals is generally carried out under neutral or alkaline conditions at a pH above 6, preferably above 8. For other minerals such as hematite and cassiterite the flotation can be carried out under more acid conditions. Conventional auxiliary chemicals can of course be used such as depressors, dispersing agents and foam regulators, for example sodium silicate, dextrin and ethoxylated nonylphenols. The collector agents are often advantageously used with fuel oils, such as diesel oil, which enhance the hydrophobic effect of the flotation reagent. The amidocarboxylic acids can also be used in combination with other known collector reagents such as fatty acids, and salts of these, and/or phosphate esters.

Mixtures of the present flotation collectors with fatty acids, i.e. carboxylic acids suitably with 6 to 24 and preferably with 14 to 22 carbon atoms, are especially suitable. The ratio between amidocarboxylic acids and fatty acids in such mixtures can vary within wide limits and 10 to 80 percent by weight of such a mixture can for example be made up of fatty acids.

The amount of amidocarboxylic acid is of course dependent on the type of mineral, the desired separation effect etc and suitable amounts are readily found by the man skilled in the art by testing in a known manner. Generally amounts above 40 g per ton of dry mineral are used and in most cases the amount is within the range 100 to 200 or 300 g, or more, per ton.

The invention is further illustrated in the following examples, which, however, are not intended to limit the same. Parts and percent relate to parts by weight and percent by weight, respectively, unless otherwise stated.

EXAMPLE 1

1 kg of apatite ore containing 11.9% of $P_2O_5$ and containing, besides fluoroapatite, silicate gangue minerals and hematite, ground to size 100% below 100 μm was placed in a 3.5 l Agitair flotation cell together with 2.5 l of water and conditioned for 3 minutes with 0.3 g of sodium silicate and then for 3 minutes with 0.15 g of N-oleic-N-formyl-3-amino-3-methylpropionic acid at a pH of 9.5. 1 drop of a foam regulator (methylisobutylcarbitol) was added and the flotation was started. The rougher concentrate was subjected to three cleanings in a 1.5 l Agitair flotation cell without addition of any flotation reagent. The concentrate and all other products were filtered, dried and analysed. 283 g of concentrate with a $P_2O_5$ content of 37.7%, corresponding to a yield of 89.6% were obtained.

In a comparative test 0.15 g of N-oleylsarcosinate were used as a collector reagent under identical conditions and this gave 272 g concentrate having a $P_2O_5$ content of 37.1%, corresponding to a yield of 84.8%.

EXAMPLE 2

1 kg of ore ground to 80% under 74 μm, containing fluorapatite (6.1% $P_2O_5$), hematite, some amount of magnetite and silicate gangue minerals, was conditioned in a 3.5 l Agitair flotation cell together with 2.5 l water and 0.2 g of sodium silicate for 5 minutes. 0.22 g of a mixture containing 15% of oleic acid and 85% of N-tallow-N-acetyl3-aminopropionic acid was added and the pH of the pulp was adjusted to 9.5 by adding some drops of NaOH. After 5 minutes conditioning with this collector the flotation was started. The rougher concentrate was cleaned three times in a 1.5 l Agitair flotation cell without addition of any other floatation agent. All products were filtrated, dried and analysed. Apatite concentrate containing 36.1% $P_2O_5$ was obtained with recovery of 92.1%.

In a comparative test 0.22 g of a mixture of 15% oleic acid and 85% N-oleylsarcosinate was used as collector under identical conditions and this gave apatite concentrate having a $P_2O_5$ content of 35.0% to a yield of 90.4%.

EXAMPLE 3

An ore containing 38.9 % fluorspar ($CaF_2$), the rest being silicate gangue minerals, was ground to 80% below 70 μm. 1 kg of the ore was placed in a 3.5 l Agitair flotation cell together with 2.5 l water and conditioned for 6 minutes with 0.6 g of sodium silicate and 0.1 g of ethoxylated nonylphenol (6 moles of ethylenoxide). 0.3 g of a mixture containing 75% of oleic acid and 25% of N-oleic-N—$COCH_2CH_3$—3-aminopropionic acid were then added together with some drops of diluted NaOH to keep the pH at 9.7. After 5 minutes conditioning the flotation was started. Rougher concentrate was cleaned twice in a 1.5 l Agitair cell without addition of any chemicals. A concentrate containing 88.7% $CaF_2$ was obtained at 96.1% recovery.

Two comparative tests were performed with the same ore and under identical conditions but using as collector (a) 0.4 g oleic acid (b) 0.3 g of a mixture containing 75% oleic acid and 25% N-oleylsarcosinate.

The test gave results as follows:

(a) concentrate containing 85.1% $CaF_2$, recovery 94.5%.

(b) concentrate containing 88.6% $CaF_2$, recovery 92.2%.

I claim:

1. A process for the separation of apatite, scheelite and fluorspar minerals from raw materials which contain said minerals in association with silica, silicates or iron mineral gangues, which process comprises the steps of:

(1) forming a pulp of said raw mineral, (2) treating said raw material pulp with a collector reagent comprising an amidocarboxylic acid having the general formula

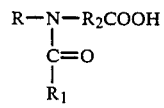

wherein R is an aliphatic group having 8 to 18 carbon atoms, $R_1$ is hydrogen or a lower aliphatic group having 1 to 4 carbon atoms or such an aliphatic group substituted with a carboxylic group, and $R_2$ is a straight or branched alkylene group with 1 to 4 carbon atoms, or a salt thereof, in an amount effective to form a froth, (3) carrying out froth flotation at a pH above 6 and collecting said minerals as a froth product while removing said gangues as tailings.

2. A process according to claim 1 wherein $R_1$ is hydrogen or a lower aliphatic group having 1 to 4 carbon atoms.

3. A process according to claim 1 wherein said collector agent is N-oleic-N-formyl-3-amino-3-methylpropionic acid.

4. A process according to claim 1 wherein said collector is N-tallow-N-acetyl-3-aminopropionic acid.

5. A process according to claim 1 wherein said collector agent is N-oleic-N—$COCH_2CH_3$—3-aminopropionic acid.

6. A process according to claim 1 wherein $R_2$ is selected from the group consisting of —$CH_2$—, —$CH_2$—$CH_2$— and $$-\underset{\underset{CH_3}{|}}{CH}-CH_2-.$$

7. A process according to claim 6 wherein $R_1$ is hydrogen or a lower aliphatic group having 1 to 4 carbon atoms.

8. A process according to claim 1 wherein said mineral is fluorapatite.

9. A process according to claim 8 wherein $R_1$ is hydrogen or a lower aliphatic group having 1 to 4 carbon atoms.

10. A process according to claim 8 wherein said collector agent is N-oleic-N-formyl-3-amino-3-methylpropionic acid.

11. A process according to claim 8 wherein said collector agent is N-tallow-N-acetyl-3-aminopropionic acid.

12. A process according to claim 8 wherein said collector agent is N-oleic-N—$COCH_2CH_3$—3-aminopropionic acid.

13. A process according to claim 8 wherein $R_2$ is selected from the group consisting of —$CH_2$—, —$CH_2$—$CH_2$— and $$-\underset{\underset{CH_3}{|}}{CH}-CH_2-.$$

14. A process according to claim 13 wherein $R_1$ is hydrogen or a lower aliphatic group having 1 to 4 carbon atoms.

15. A process according to claim 1 wherein said mineral is fluorspar.

16. A process according to claim 15 wherein $R_1$ is hydrogen or a lower aliphatic group having 1 to 4 carbon atoms.

17. A process according to claim 15 wherein said collector agent is N-oleic-N-formyl-3-amino-3-methylpropionic acid.

18. A process according to claim 15 wherein said collector agent is N-tallow-N-acetyl-3-aminopropionic acid.

19. A process according to claim 15 wherein said collector agent is N-oleic-N—$COCH_2CH_3$—3-aminopropionic acid.

* * * * *